US011203885B2

(12) United States Patent
Su

(10) Patent No.: US 11,203,885 B2
(45) Date of Patent: Dec. 21, 2021

(54) COMBINATION LOCK FOR ELECTRONIC DEVICES

(71) Applicant: Jason Su, Changhua (TW)

(72) Inventor: Jason Su, Changhua (TW)

( * ) Notice: Subject to any disclaimer, the term of this patent is extended or adjusted under 35 U.S.C. 154(b) by 143 days.

(21) Appl. No.: 16/214,453

(22) Filed: Dec. 10, 2018

(65) Prior Publication Data

US 2020/0181950 A1 Jun. 11, 2020

(51) Int. Cl.
*E05B 37/02* (2006.01)
*E05B 73/00* (2006.01)

(52) U.S. Cl.
CPC ..... *E05B 73/0082* (2013.01); *E05B 37/02* (2013.01); *E05B 73/0005* (2013.01)

(58) Field of Classification Search
CPC .. E05B 73/00; E05B 73/0005; E05B 73/0082; E05B 37/02
USPC ..... 70/15, 57, 58
See application file for complete search history.

(56) References Cited

U.S. PATENT DOCUMENTS 3,905,214 A * 9/1975 Bell ..... A63C 11/006 70/58
6,058,744 A * 5/2000 Ling ..... E05B 37/025 70/28
6,619,080 B1 * 9/2003 Yu ..... E05B 73/0005 70/14
6,619,081 B1 * 9/2003 Yu ..... E05B 73/0005 70/14
9,062,476 B2 * 6/2015 Kao ..... E05B 73/0005
10,066,423 B2 * 9/2018 Kao ..... G06F 1/16
10,378,249 B1 * 8/2019 Lee ..... E05B 73/0082
10,400,482 B2 * 9/2019 Kao ..... G06F 1/1616
10,563,432 B2 * 2/2020 Kao ..... E05B 73/0082
2003/0200775 A1 * 10/2003 Yu ..... E05B 37/025 70/58
2006/0081021 A1 * 4/2006 Merrem ..... E05B 73/0082 70/58
2007/0169523 A1 * 7/2007 Lu ..... E05B 73/0082 70/58
2008/0034816 A1 * 2/2008 Lu ..... E05B 73/0082 70/58
2008/0163654 A1 * 7/2008 Avganim ..... E05B 73/0082 70/58
2011/0061427 A1 * 3/2011 Mahaffey ..... E05B 73/0082 70/58

(Continued)

*Primary Examiner* — Suzanne L Barrett
(74) *Attorney, Agent, or Firm* — Che-Yang Chen; Law Office of Michael Chen

(57) ABSTRACT

A combination lock for electronic devices may include a shell, a pushing button, two engaging arms, and a lock cable. The main body has a plurality digit wheels disposed at an end thereof, and the digit wheels are configured to control whether the main body is able to move in axial direction. Moreover, the main body includes a slot-head rod at the other end thereof, and a lock block is installed between the slot-head rod and the digit wheels. Also, the lock block comprises a first inclined portion faced to the slot-head rod, and a spring disposed on the main body is coupled between the lock block and the digit wheels. Each of the engaging arms has a connecting portion and a hook portion, and a locating portion is formed therebetween. An elastic member is disposed on the locating portions of the two engaging arms.

5 Claims, 7 Drawing Sheets

(56) References Cited

U.S. PATENT DOCUMENTS

| | | | | |
|---|---|---|---|---|
| 2012/0006080 | A1* | 1/2012 | Yu | E05B 37/02 70/58 |
| 2014/0069153 | A1* | 3/2014 | Wu | E05B 73/0082 70/58 |
| 2015/0059422 | A1* | 3/2015 | Kao | E05B 73/00 70/58 |
| 2017/0110831 | A1* | 4/2017 | Su | E05B 73/0082 |
| 2020/0080346 | A1* | 3/2020 | Wu | E05B 73/0082 |

* cited by examiner

COMBINATION LOCK FOR ELECTRONIC DEVICES

FIELD OF THE INVENTION

The present invention relates to a lock and more particularly to a combination lock for electronic devices with simplified structure and high applicability.

BACKGROUND OF THE INVENTION

Nowadays, it is common to see 3C products such as desktop computers and laptops which are used for education or other purposes and placed in computer classrooms, libraries, offices, shopping malls or other public places. However, because of small volume, the 3C products, especially laptops, are easily to be moved or stolen. Thus, the 3C products always are locked through a lock.

However, the conventional lock for electronic product has following disadvantages: (i) there are so many kinds of locks in the market, and each of locks has different and complicated components or mechanisms thus increasing the manufacturing costs; (ii) a lock connector or a lock hole in different laptops are different thereby lowering the practicability, not to mention the fact that some laptops have no lock connector; and (iii) some conventional locks for electronic product can be locked and unlocked through both digit dials and key, but it will have complex components and need precise assembly, thereby increasing material costs and reducing convenience in operation. Therefore, there remains a need for a new and improved design for a combination lock for electronic product to overcome the problems presented above.

SUMMARY OF THE INVENTION

The present invention provides a combination lock for electronic product which comprises a main body, a shell, a pushing button, two engaging arms, and a lock cable. The main body has a plurality digit wheels disposed at an end thereof, and the digit wheels are configured to control whether the main body is able to move in axial direction. Moreover, the main body comprises a slot-head rod at the other end thereof, and a lock block is installed between the slot-head rod and the digit wheels. Also, the lock block comprises a first inclined portion faced to the slot-head rod, and a spring disposed on the main body is coupled between the lock block and the digit wheels. The shell comprises two half pieces which are configured to fit together to cover the main body, and each of the digit wheels has a section exposed outside the shell. Furthermore, the shell has a space to accommodate the lock block, and a head portion is formed at a front portion of the shell. Additionally, the slot-head rod is configured to axially protrude from the head portion, and the head portion has two vertical recess portions respectively formed at two sides of the slot-head rod. Also, an elongated opening formed at a front end of the shell is communicated with the two recess portions. The pushing button has two second inclined portions located symmetrically and extended from an inner surface thereof. Moreover, the pushing button is inserted into the space of the shell through the second inclined portions, and the two second inclined portions are configured to respectively abut against the first inclined portion, and the slot-head rod is located between the two second inclined portions. Each of the engaging arms has a connecting portion and a hook portion respectively formed at two ends thereof, and a locating portion is formed between the connecting portion and the hook portion. Furthermore, each of the connecting portions is configured to pivotally connect to the recess portion of the shell, and the hook portion is adapted to forwardly protrude from the elongated opening of the shell. An elastic member is disposed on the locating portions of the two engaging arms, and through elastic force, the elastic member is adapted to keep the engaging arms to clamp on the slot-head rod as an initial positions. The lock cable has a connecting ring at an end thereof, and the connecting ring is configured to be disposed on an outer periphery of the head portion of the shell.

In one embodiment, an annular groove is formed on the outer periphery of the head portion, and a C-shaped engaging piece is adapted to engage in the annular groove so as to prevent the connecting ring from detaching from the shell, and the connecting ring is adapted to cover and avoid the C-shaped engaging piece from disassembly from the head portion.

In another embodiment, the elastic member is a rubber ring.

In still another embodiment, a pad is coupled on the front end of the shell.

In a further embodiment, each of two neck portions having a smaller diameter than the hook portion and locating portion is formed therebetween, and the two neck portions are configured to increase the opening angle between the two hook portions.

Comparing with conventional 3C product lock, the present invention is advantageous because: (i) with the cooperation between the spring, the slot-head rod, the engaging arms, the hook portions, and the elastic member, the combination lock of the present invention can be used for the electronic product with different lock holes including types of slot-head, cross, and fishtail, and even the lock hole is enlarged or shrunken in a reasonable range, the hook portions are able to hook on the lock hole to achieve the anti-theft effect, which has high applicability; and (ii) the combination lock of the present invention can achieve the anti-theft effect with less components, which is easily assembled and has lower costs.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
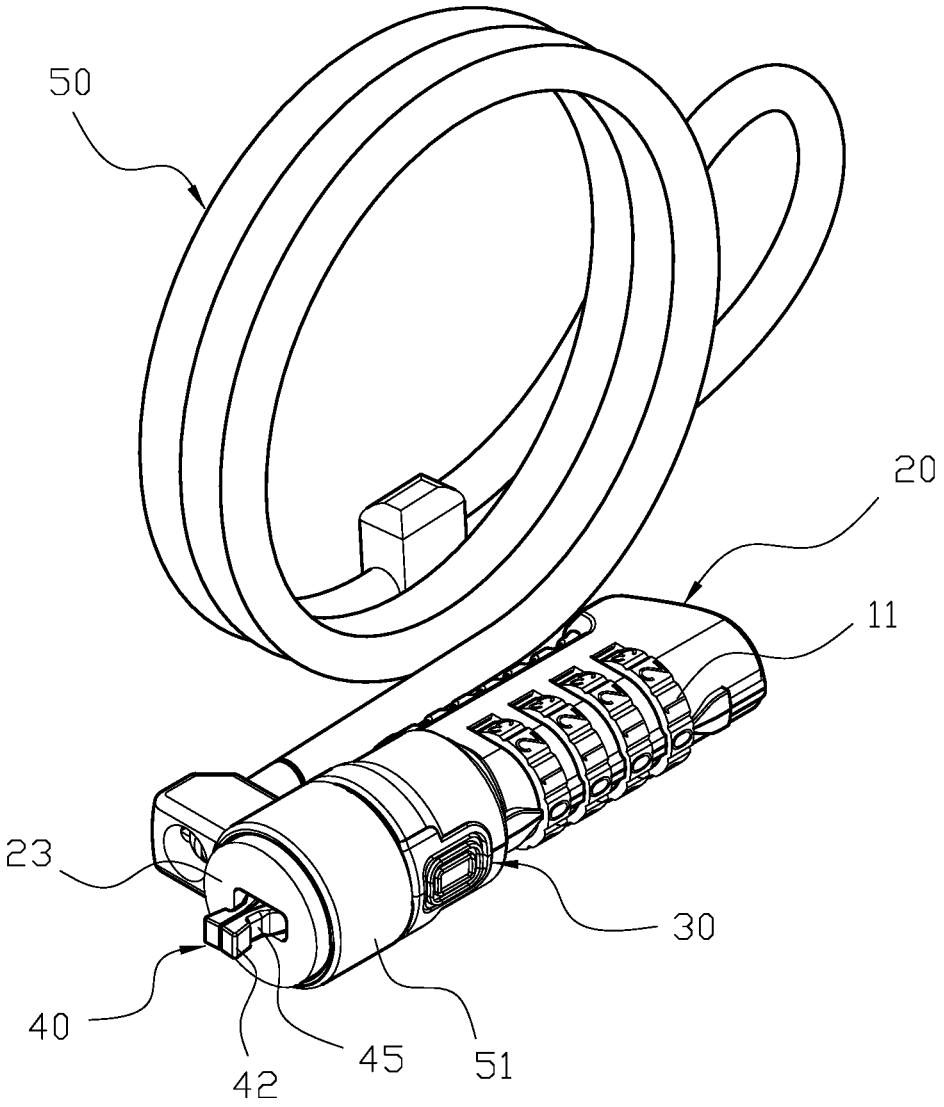
FIG. 1 is a three-dimensional assembly view of a combination lock for electronic devices in the present invention.
Figure 2:
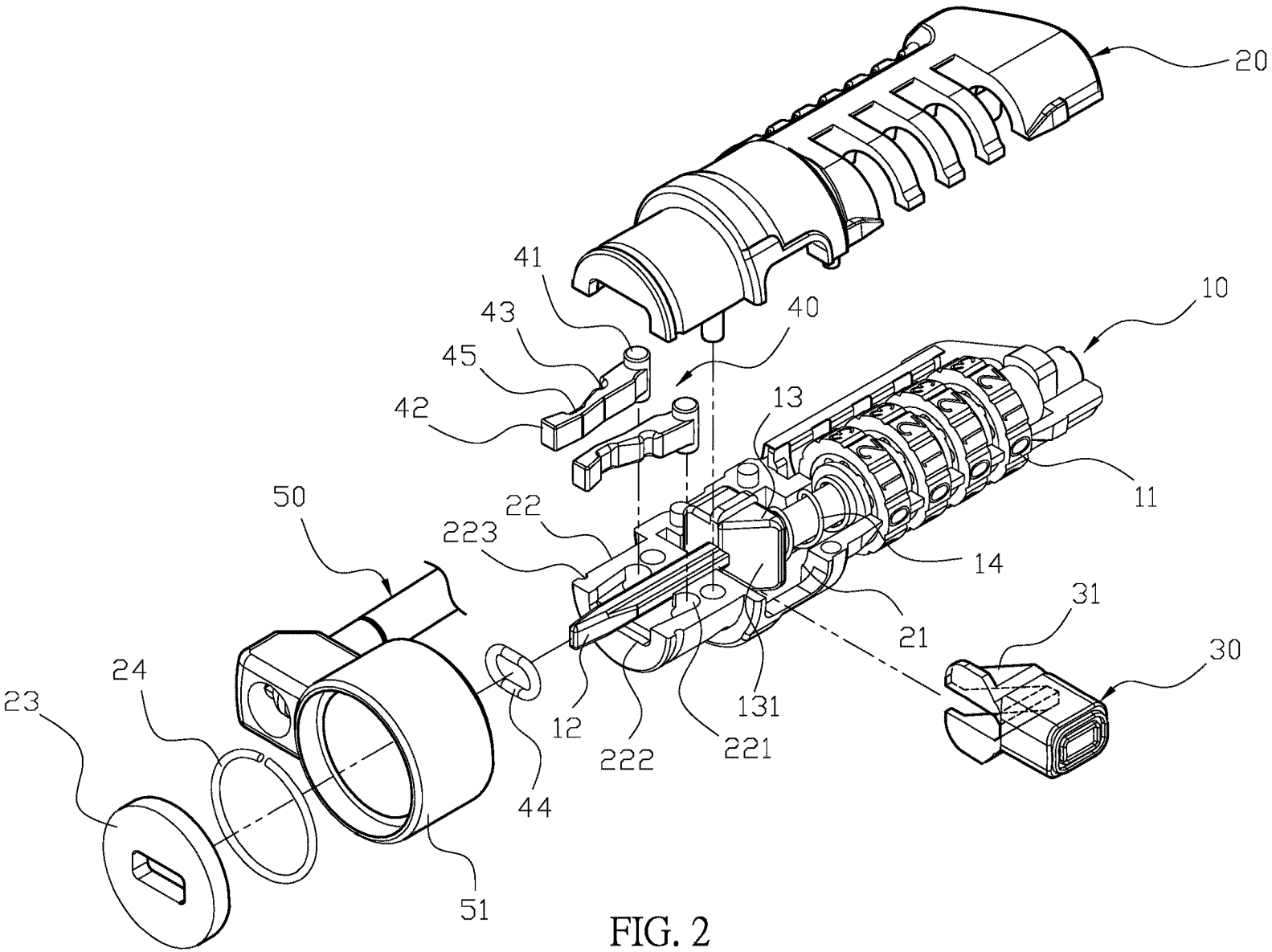
FIG. 2 is a three-dimensional exploded view of the combination lock for electronic devices in the present invention.
Figure 3:
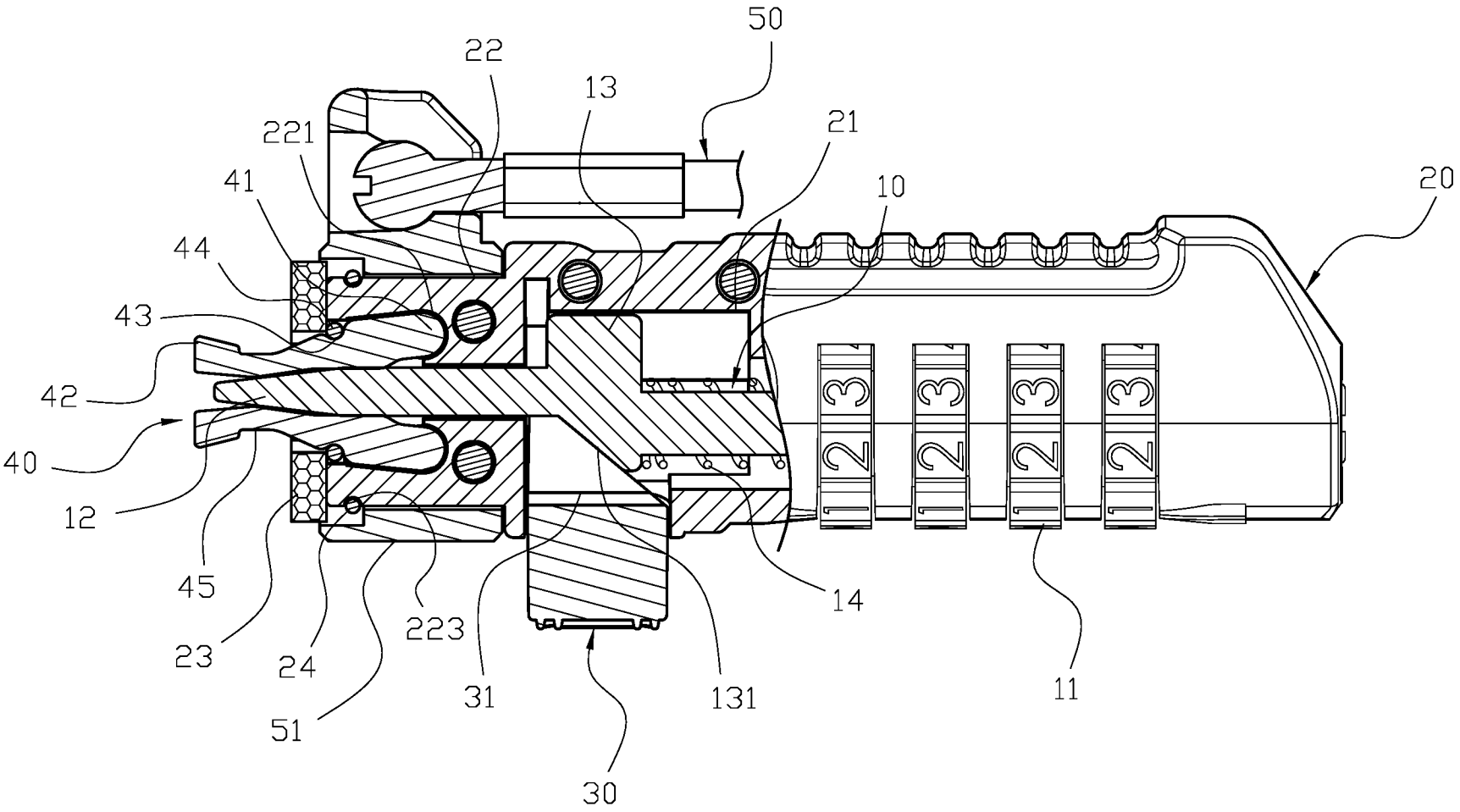
FIG. 3 is a sectional view of the combination lock for electronic devices in the present invention.

In order to further understand the goal, characteristics and effect of the present invention, a number of embodiments along with the drawings are illustrated as following:

Referring to FIGS. 1 to 3, the present invention provides a combination lock for electronic devices which comprises a main body (10), a shell (20), a pushing button (30), two engaging arms (40), and a lock cable (50). The main body (10) has a plurality digit wheels (11) disposed at an end thereof, and the digit wheels (11) are configured to control whether the main body (10) is able to move in axial direction. Moreover, the main body (10) comprises a slot-head rod (12) at the other end thereof, and a lock block (13) is installed between the slot-head rod (12) and the digit wheels (11). Also, the lock block (13) comprises a first inclined portion (131) faced to the slot-head rod (12), and a spring (14) disposed on the main body (10) is coupled between the lock block (13) and the digit wheels (11). The shell (20) comprises two half pieces which are configured to fit together to cover the main body (10), and each of the digit wheels (11) has a section exposed outside the shell (20). Furthermore, the shell (20) has a space (21) to accommodate the lock block (13), and a head portion (22) is formed at a front portion of the shell (20). Additionally, the slot-head rod (12) is configured to axially protrude from the head portion (22), and the head portion (22) has two vertical recess portions (221) respectively formed at two sides of the slot-head rod (12). Also, an elongated opening (222) formed at a front end of the shell (20) is communicated with the two recess portions (221), and a pad (23) is coupled on the front end of the shell (20) so as to protect the main body (10) from scratch and damage. The pushing button (30) has two second inclined portions (31) extended from an inner surface thereof, and the two second inclined portions (31) are located symmetrically. Moreover, the pushing button (30) is inserted into the space (21) of the shell (20) through the second inclined portions (31), and the two second inclined portions (31) are configured to fit and respectively abut against the first inclined portion (131), and the slot-head rod (12) is located between the two second inclined portions (31). Each of the engaging arms (40) has a connecting portion (41) and a hook portion (42) respectively formed at two ends thereof, and a locating portion (43) is formed between the connecting portion (41) and the hook portion (42). Furthermore, each of the connecting portions (41) is configured to pivotally connect to the recess portion (221) of the shell (20), and the hook portion (42) is adapted to forwardly protrude from the elongated opening (222) of the shell (20). An elastic member (44) which is made of rubber is disposed on the locating portions (43) of the two engaging arms (40), and through elastic force, the elastic member (44) is adapted to keep the engaging arms (40) to clamp on the slot-head rod (12) as an initial position. Moreover, each of two neck portions (45) having a smaller diameter than the hook portion (42) and locating portion (43) is formed therebetween, and the two neck portions (45) are configured to increase the opening angle between the two hook portions (42). The lock cable (50) has a connecting ring (51) at an end thereof, and the connecting ring (51) is configured to be disposed on an outer periphery of the head portion (22) of the shell (20). Also, the lock cable (50) is adapted to be wound around an immovable object to achieve the burglar-proof effect. In addition, an annular groove (223) is formed on the outer periphery of the head portion (22), and a C-shaped engaging piece (24) is adapted to engage in the annular groove (223) so as to prevent the connecting ring (51) from detaching from the shell (20), and the connecting ring (51) is adapted to cover and avoid the C-shaped engaging piece (24) from disassembly from the head portion (22).

Structurally, referring to FIGS. 1 to 3, the elastic member (44) is disposed on the two locating portions (43) of the two engaging arms (40), and the two connecting portions (41) of the engaging arms (40) are respectively and pivotally connected to the two recess portions (221) of the head portion (22), and the two hook portions (42) forwardly penetrate through the elongated opening (222). The spring (14) and the digit wheels (11) are sequentially disposed on the main body (10), and the spring (14) is coupled between the lock block (13) and the digit wheels (11). The two second inclined portions (31) of the pushing button (30) are configured to couple the slot-head rod (12) therebetween, and the second inclined portions (31) are abutted against the first inclined portion (131) of the lock block (13). Thereafter, the slot-head rod (12) is adapted to penetrate the head portion (22) of the shell (20) between the two engaging arms (40), and the slot-head rod (12) is pressed downwardly to position the lock block (13), the pushing button (30), and the digit wheels (11) in the shell (20). Also, the lock block (13) is accommodated in the space (21) of the shell (20) before the two half pieces of the shell (20) are fit together. In this time, both of the digit wheels (11) and the pushing button (30) are partially exposed out of the shell (20). Moreover, the connecting ring (51) of the lock cable (50) is disposed on the head portion (22), and the C-shaped engaging piece (24) is engaged with the annular groove (223) of the head portion (22) so as to enable the connecting ring (51) to be rotatable relative to the shell (20).

Figure 4:
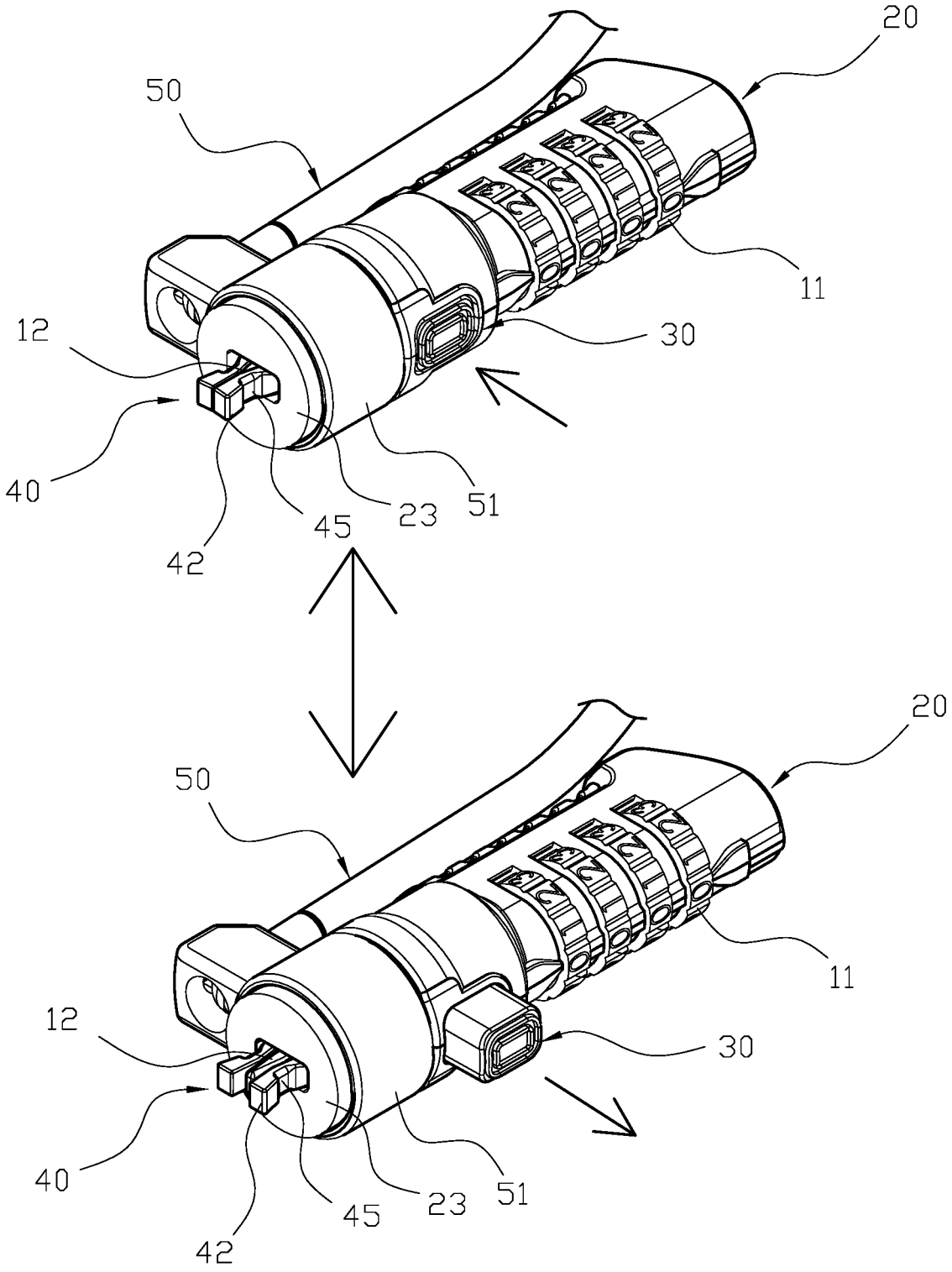
FIG. 4 is a schematic view illustrating the combination lock for electronic devices in the present invention is in use.
Figure 5:
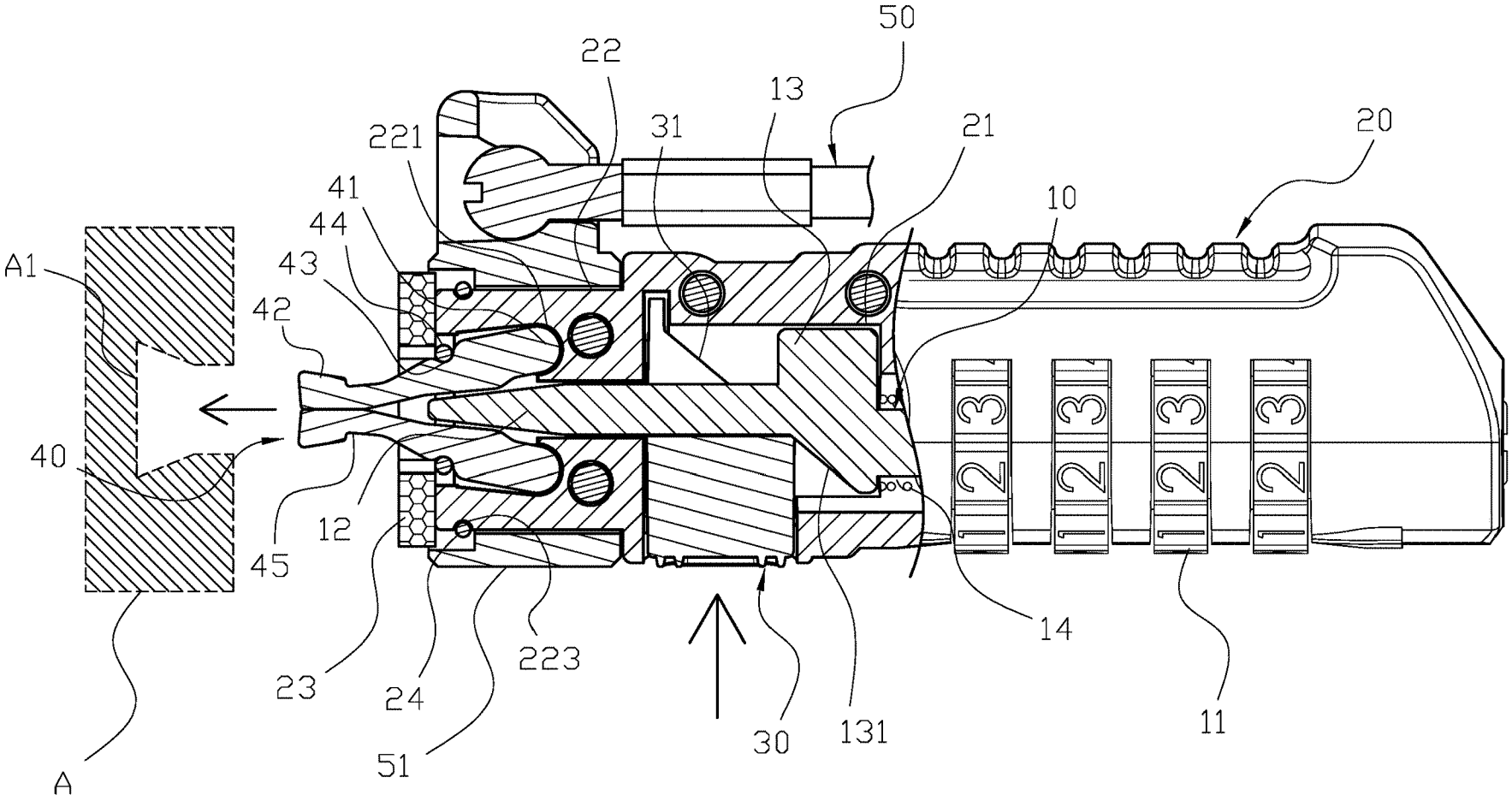
FIG. 5 is another schematic view illustrating the combination lock for electronic devices in the present invention is in use.
Figure 6:
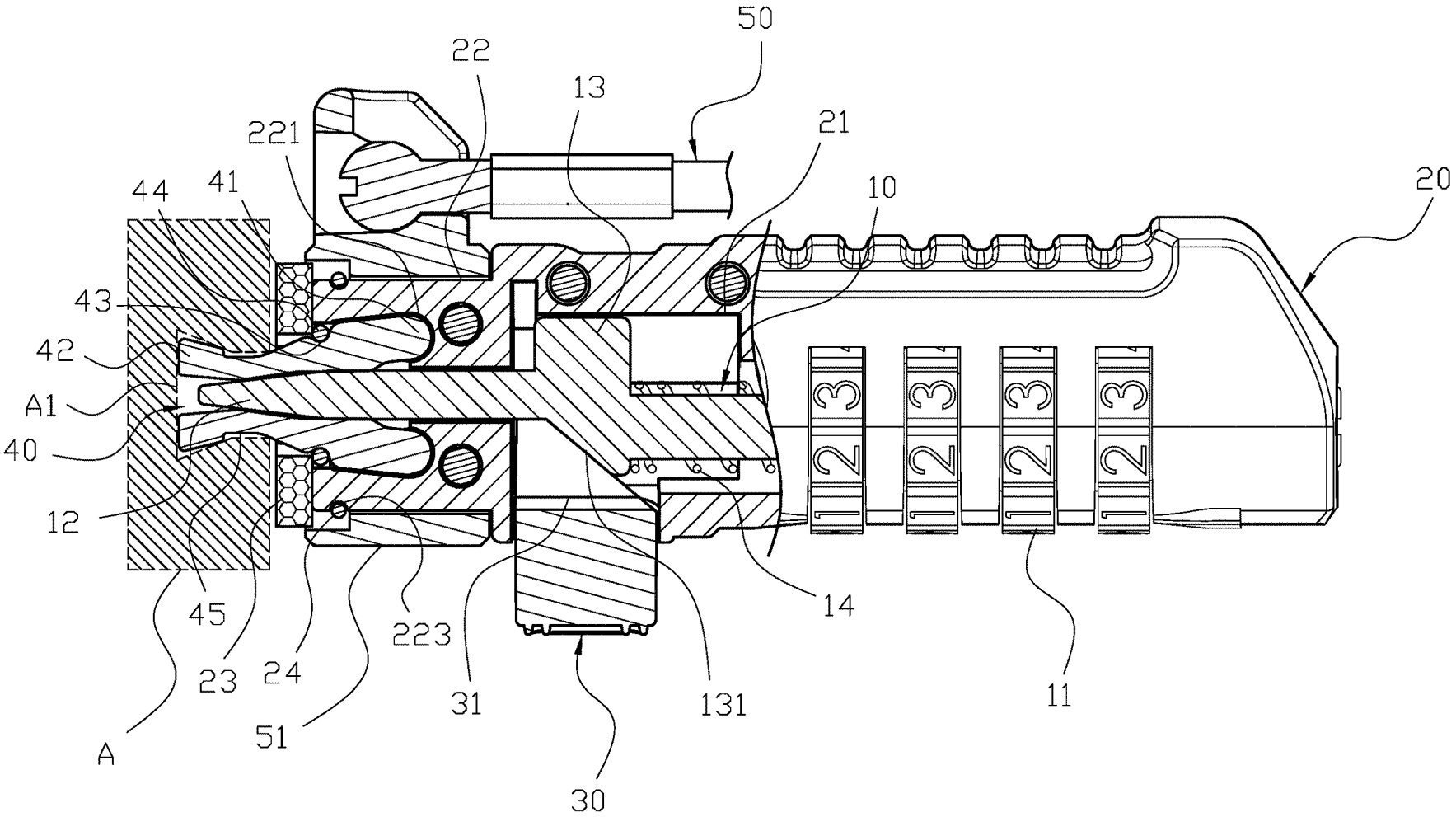
FIG. 6 is a third schematic view illustrating the combination lock for electronic devices in the present invention is in use.

In actual application, referring to FIGS. 4 to 6, when the digit wheels (11) is rotated to a designed code, the main body (10) is at an unlocked position. The lock block (13) is adapted to be pushed by the spring (14) to move toward the head portion (22). Meanwhile, the first inclined portion (131) of the lock block (13) is adapted to push the pushing button (30) outwardly and enable the pushing button (30) to stick out of the shell (20). Furthermore, the slot-head rod (12) of the main body (10) is configured to penetrate forwardly through the elongated opening (222) of the head portion (22) so as to separate the two hook portions (42) of the two engaging arms (40) apart. When the combination lock of the present invention is used for an electronic product (A), a user can keep pressing the pushing button (30), and the second inclined portions (31) are adapted to push the first inclined portion (131) of the lock block (13) and meanwhile compress the spring (14), so that both of the lock block (13) and the slot-head rod (12) are moved toward the digit wheels (11). At this time, the engaging arms (40) are not separated by the slot-head rod (12), and there are minimum separations between the two hook portions (42) and between the two neck portions (45) such that the hook portions (42) and the neck portions (45) are easily inserted into a lock hole (A1) of the electronic product (A). Then, when the user releases the pushing button (30), the spring (14) is configured to push the lock block (13) and the slot-head rod (12) outwardly, and the slot-head rod (12) is adapted to move forwardly to separate the two engaging arms (40) apart so as to enable the hook portions (42) to hook on the lock hole (A1). Then, the user can dial the digit wheels (11) to a random number rather than the designed code so as to achieve the locking effect for the electronic product (A). On the other hand, when the combination lock of the present invention needs to be unlocked, a user can dial the digit wheels (11) to the designed code and press the pushing button (30), and the slot-head rod (12) is adapted to be moved back to its initial position, and through the elastic force, the elastic member (44) is configured to pull back and keep the two engaging arms (40) to couple together again.

Figure 7:
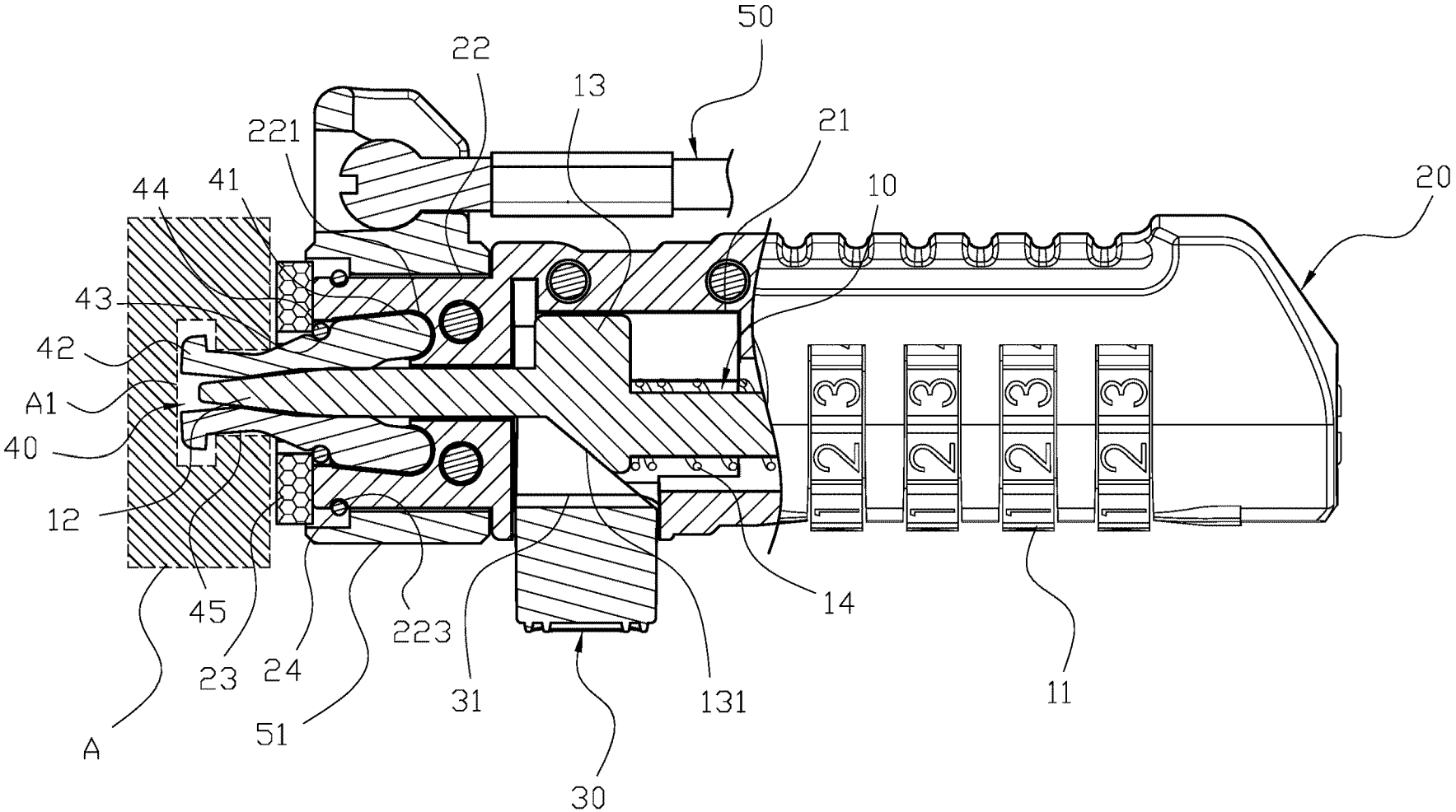
FIG. 7 is a schematic view of another embodiment illustrating the combination lock for electronic devices in the present invention is in use.

Comparing with conventional 3C product lock, the present invention is advantageous because: (i) with the cooperation between the spring (14), the slot-head rod (12), the engaging arms (40), the hook portions (42), and the elastic member (44), the combination lock of the present invention can be used for the electronic product (A) with different lock holes (A1) including types of slot-head, cross, and fishtail (as shown in FIGS. 6 and 7), and even the lock hole (A1) is enlarged or shrunken in a reasonable range, the hook portions (42) are able to hook on the lock hole (A1) to achieve the anti-theft effect, which has high applicability; and (ii) the combination lock of the present invention can achieve the anti-theft effect with less components, which is easily assembled and has lower costs.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A combination lock for electronic devices comprising a main body, a shell, a pushing button, two engaging arms, and a lock cable;

wherein the main body has a plurality of digit wheels disposed at an end thereof, and the digit wheels are configured to control whether the main body is able to move in axial direction; a slot-head rod is formed at the other end of the main body, and a lock block is installed between the slot-head rod and the digit wheels; the lock block comprises a first inclined portion faced to the slot-head rod, and a spring disposed on the main body is coupled between the lock block and the digit wheels;

wherein the shell comprises two half pieces which are configured to fit together to cover the main body, and each of the digit wheels has a section exposed outside the shell; the shell has a space to accommodate the lock block, and a head portion is formed at a front portion of the shell; the slot-head rod is configured to axially protrude from the head portion, and the head portion has two vertical recess portions respectively formed at two sides of the slot-head rod; an elongated opening formed at a front end of the shell is communicated with the two recess portions;

wherein the pushing button has two second inclined portions located symmetrically and extended from an inner surface thereof; the pushing button is inserted into the space of the shell through the second inclined portions, and the two second inclined portions are configured to abut against the first inclined portion, and the slot-head rod is located between the two second inclined portions;

wherein each of the engaging arms has a connecting portion and a hook portion respectively formed at two ends thereof, and a locating portion having a semi-cylindrical recess is formed between the connecting portion and the hook portion, and an opening of the semi-cylindrical recess on each engaging arm faces away from each other and horizontally juxtaposed; each of the connecting portions is configured to pivotally connect to the recess portion of the shell, and the hook portion is adapted to forwardly protrude from the elongated opening of the shell; an elastic member is partially received in the semi-cylindrical recess of each of the locating portions of the two engaging arms, and through elastic force, the elastic member is adapted to keep the engaging arms to clamp on the slot-head rod as an initial position; and wherein the lock cable has a connecting ring at an end thereof, and the connecting ring is configured to be disposed on an outer periphery of the head portion of the shell, and the lock cable is adapted to be wound around an immovable object to achieve the burglar-proof effect.

2. The combination lock for electronic devices of claim 1, wherein an annular groove is formed on the outer periphery of the head portion, and a C-shaped engaging piece is adapted to engage in the annular groove so as to prevent the connecting ring from detaching from the shell, and the connecting ring is adapted to cover and avoid the C-shaped engaging piece from disassembly from the head portion.

3. The combination lock for electronic devices of claim 1, wherein the elastic member is a rubber ring.

4. The combination lock for electronic devices of claim 1, wherein a pad is coupled on the front end of the shell.

5. The combination lock for electronic devices of claim 1, wherein each of two neck portions having a smaller diameter than the hook portion and the locating portion is formed therebetween, and the two neck portions are configured to increase the opening angle between the two hook portions.

* * * * *